US011817070B2

(12) United States Patent
Karasawa et al.

(10) Patent No.: US 11,817,070 B2
(45) Date of Patent: Nov. 14, 2023

(54) ARBITRARY SIGNAL INSERTION METHOD AND ARBITRARY SIGNAL INSERTION SYSTEM

(71) Applicant: Masuo Karasawa, Shanghai (CN)

(72) Inventors: Masuo Karasawa, Shanghai (CN); Kotaro Kashiwa, Kawasaki (JP)

(73) Assignee: Masuo Karasawa, Shanghai (CN)

( * ) Notice: Subject to any disclaimer, the term of this patent is extended or adjusted under 35 U.S.C. 154(b) by 279 days.

(21) Appl. No.: 17/049,701

(22) PCT Filed: Mar. 26, 2019

(86) PCT No.: PCT/JP2019/012875
§ 371 (c)(1),
(2) Date: Oct. 22, 2020

(87) PCT Pub. No.: WO2019/208067
PCT Pub. Date: Oct. 31, 2019

(65) Prior Publication Data

US 2021/0241740 A1 Aug. 5, 2021

(30) Foreign Application Priority Data

Apr. 24, 2018 (JP) ..... 2018-082899

(51) Int. Cl.
*G10H 1/40* (2006.01)
*G10H 1/00* (2006.01)
*G10L 19/018* (2013.01)

(52) U.S. Cl.
CPC ..... *G10H 1/40* (2013.01); *G10H 1/0066* (2013.01); *G10L 19/018* (2013.01); *G10H 2210/071* (2013.01); *G10H 2240/325* (2013.01)

(58) Field of Classification Search
CPC .. G10H 1/40; G10H 1/0066; G10H 2210/071; G10H 2240/325; G10L 19/018
(Continued)

(56) References Cited

U.S. PATENT DOCUMENTS 4,694,724 A * 9/1987 Kikumoto ..... G10H 1/40 84/DIG. 29
5,256,832 A * 10/1993 Miyake ..... G10H 1/40 84/645

(Continued)

FOREIGN PATENT DOCUMENTS

CN 105980977 A * 9/2016 ..... G06F 3/165
JP 11219172 A * 8/1999

(Continued)

OTHER PUBLICATIONS

International Search Report dated Jun. 18, 2019, issued in counterpart Application No. PCT/JP2019/012875. (2 pages).

(Continued)

*Primary Examiner* — Christina M Schreiber
(74) *Attorney, Agent, or Firm* — WHDA, LLP

(57) ABSTRACT

An arbitrary signal insertion method and an arbitrary signal insertion system, capable of inserting a transmittable arbitrary signal (insertion information M) at a predetermined insertion timing into an acoustic sound played in real time. An insertion timing is previously associated with a predetermined time code with master rhythm information. An acoustic sound into which insertion information will be inserted is music sound generated by a real-time performance unit and is accompanied by a second rhythm. The insertion information is inserted into the music sound generated by the real-time performance unit at the insertion timing after the rhythm of master rhythm information and the rhythm of the music sound generated by the real-time performance unit are synchronized. The synchronization is (Continued)

achieved by a rhythm transmitter which notifies a player of a rhythm session musical instrument of the rhythm of the master rhythm information with sound or light.

6 Claims, 12 Drawing Sheets

(58) Field of Classification Search
USPC ..... 84/611
See application file for complete search history.

(56) References Cited

U.S. PATENT DOCUMENTS 6,835,885 B1 * 12/2004 Kondo ..... G10H 7/008 84/612
7,534,951 B2 * 5/2009 Yamashita ..... G10H 1/368 84/611
8,022,287 B2 * 9/2011 Yamashita ..... G11B 27/105 84/649
10,134,407 B2 * 11/2018 Karasawa ..... G10L 19/167
2003/0154379 A1 * 8/2003 Kawano ..... G10L 19/018 704/E19.009
2005/0188821 A1 * 9/2005 Yamashita ..... G10H 1/40 84/611
2005/0204904 A1 * 9/2005 Lengeling ..... G10H 1/40 704/E21.017
2005/0247185 A1 * 11/2005 Uhle ..... G10H 1/40 84/616
2006/0075886 A1 * 4/2006 Cremer ..... G10H 1/40 84/635
2008/0011149 A1 * 1/2008 Eastwood ..... G10H 1/368 84/611
2008/0208740 A1 * 8/2008 Uehara ..... G10H 1/40 705/40
2009/0056526 A1 * 3/2009 Yamashita ..... G10L 25/48 84/611
2012/0006183 A1 * 1/2012 Humphrey ..... G10H 1/40 84/611
2017/0125025 A1 * 5/2017 Karasawa ..... G10L 19/167
2019/0237055 A1 * 8/2019 Maezawa ..... G10G 3/04
2021/0241740 A1 * 8/2021 Karasawa ..... G10L 19/018
2022/0337967 A1 * 10/2022 Yamaguchi ..... H04S 3/008

FOREIGN PATENT DOCUMENTS

JP H11-219172 A 8/1999
JP 2001-282234 A 10/2001
JP 2001282234 A * 10/2001
JP 2003-233372 A 8/2003
JP 2003233372 A * 8/2003 ..... G10H 1/0066
JP 2004-62024 A 2/2004
JP 2004062024 A * 2/2004
JP 2008275975 A * 11/2008
JP 2015-197497 A 11/2015
JP 2015197497 A * 11/2015 ..... G10L 19/018

OTHER PUBLICATIONS

Written Opinion dated Jun. 18, 2019, issued in counterpart Application No. PCT/JP2019/012875. (4 pages).

* cited by examiner

ARBITRARY SIGNAL INSERTION METHOD AND ARBITRARY SIGNAL INSERTION SYSTEM

FIELD OF THE INVENTION

The present invention relates to an arbitrary signal insertion method and an arbitrary signal insertion system capable of easily inserting an arbitrary signal into an acoustic sound (music) actually played at a concert hall or the like.

BACKGROUND

As for an arbitrary signal insertion method for inserting a transmittable arbitrary signal having a predetermined frequency into an acoustic sound composed of plural sounds at a predetermined timing, there is a method described in Patent Document 1 as one of such conventional techniques. In the method described in Patent Document 1, a control code for controlling a peripheral device is embedded in an acoustic sound (acoustic signal) of an existing music content recorded on a recording medium such as a CD or a DVD, and the control code is emitted at a predetermined timing, thereby controlling the peripheral device. The acoustic sound (acoustic signal) in which the control code is embedded is reproduced by a reproduction device such as a video/music player, and the control code is extracted from the reproduced sound using an extraction device, thus enabling the controlling of the peripheral device. The method described in Patent Document 1 employs a technique in which a predetermined number of samples are read as one frame and a control code is embedded in an acoustic sound (acoustic signal) included in this frame by a digital watermark technique.

PRIOR ART DOCUMENTS

Patent Documents

Patent document 1: JP2006-323161A

SUMMARY OF THE INVENTION

Problem to be Solved by the Invention

According to the conventional technique described in Patent Document 1, an arbitrary signal (control code) can be inserted into the acoustic sound at a predetermined desired timing. However, the acoustic sound in which the arbitrary signal (control code) is inserted is a music content that is preliminarily recordable on a recording medium such as a CD, a DVD, or the like. That is, in the conventional technique described in Patent Document 1, it has been technically difficult to insert an arbitrary signal (control code) directly into an acoustic sound of which rhythm can be changed according to the player, time, place and the like, that is, an acoustic sound that is not always played in a predetermined rhythm, for example, that is actually played by a player(s) at a concert hall.

It is an object of the present invention to provide an arbitrary signal insertion method and an arbitrary signal insertion system capable of easily inserting an arbitrary signal into an acoustic sound being played in real time, such as a performance of a player(s) at a concert hall, at a predetermined insertion timing. In addition, another object of the present invention is to remotely operate and control a peripheral device using the inserted arbitrary signal.

Means for Solving the Problems

For solving the aforementioned problems, the present invention is an arbitrary signal insertion method for inserting a transmittable arbitrary signal having a predetermined frequency into an acoustic sound at a desired insertion timing, wherein the insertion timing is previously associated with a predetermined time code together with a first rhythm, the acoustic sound is composed of a plurality of sounds with a second rhythm, and the arbitrary signal is inserted into the acoustic sound at the insertion timing after the first rhythm and the second rhythm are synchronized. According to the present invention, an arbitrary signal can be easily and accurately inserted in, for example, an acoustic sound of actual performance by a player, i.e. an acoustic sound of which rhythm is changeable at every performance or in the middle of the performance, at a predetermined desired timing.

The present invention for solving the aforementioned problems is characterized, in addition to the aforementioned features, in that the second rhythm is an acoustic rhythm actually played by a player, and synchronization between the first rhythm and the second rhythm is achieved by notifying the player of the rhythm information related to the first rhythm.

According to the present invention, the synchronization between the two rhythms can be achieved by promoting the player to play the acoustic sound with the first rhythm. As a result, it is possible to easily and accurately insert an arbitrary signal directly into an actually performed acoustic sound at a predetermined insertion timing determined in advance.

The present invention for solving the aforementioned problems is characterized, in addition to the aforementioned features, the second rhythm is an acoustic rhythm actually played by a player, and, after it is confirmed that the second rhythm is synchronized with the first rhythm, the arbitrary signal is inserted into the acoustic sound at the insertion timing.

Experiments have confirmed that the rhythm of the acoustic sound being played by the player is kept constant for at least a predetermined amount of time (for example, 40 seconds). That is, immediately after the rhythm of player's acoustic sound (second rhythm) is synchronized with the first rhythm, these two rhythms are synchronized for at least the predetermined amount of time. Therefore, in the present invention, an arbitrary signal is inserted into the actually played acoustic sound at the desired insertion timing within the predetermined amount of time (while these rhythms are supposed to be synchronized). As a result, the arbitrary signal can be easily and accurately inserted directly into the actually played acoustic sound at the predetermined insertion timing.

The present invention for solving the aforementioned problems is characterized, in addition to the aforementioned features, the synchronization is confirmed by comparing the second rhythm included in MIDI data related to the actually played acoustic sound with the first rhythm included in the MIDI data related to musical score information of the prerecorded acoustic sound.

According to the present invention, the synchronization between the first rhythm and the second rhythm can be easily and accurately confirmed by using electric signals called as MIDI data.

The present invention for solving the aforementioned problems is characterized, in addition to the aforementioned features, the arbitrary signal inserted into the acoustic sound includes at least insertion information for operating and controlling a peripheral device to perform a predetermined operation.

According to the present invention, by the arbitrary signal inserted in the acoustic sound, it is possible to command the peripheral device to perform a predetermined operation. For example, the display color of a mobile terminal can be changed according to the rhythm.

The present invention for solving the aforementioned problems is characterized, in addition to the aforementioned features, the peripheral device comprises a plurality of peripheral devices, and the insertion information is configured to command the peripheral devices to perform different operations depending on respective specific information of the peripheral devices. Among the different operations, there is do-nothing operation. According to the present invention, for example, if there are a predetermined group and the other predetermined group among a large number of audiences in a concert hall, it is possible to make the operation for the mobile terminals of the predetermined group different from the operation for the mobile terminals of the other predetermined group, thereby allowing various performances at the concert hall.

Further, for solving the aforementioned problems, the present invention is an arbitrary signal insertion system for inserting a transmittable arbitrary signal having a predetermined frequency into an acoustic sound at a desired insertion timing, comprising: an arithmetic unit which stores the insertion timing in association with a predetermined time code together with a preset first rhythm; a start command section for commanding the arithmetic unit to start performance; a real-time performance unit for outputting an acoustic sound composed of a second rhythm actually performed by a player; a rhythm transmitter for emitting rhythm information of the acoustic sound actually performed to the player of the real-time performance unit; and a peripheral device which receives the arbitrary signal inserted in the acoustic sound output from the real-time performance unit and is operated and controlled by insertion information included in the arbitrary signal, wherein the arithmetic unit outputs the first rhythm to the rhythm transmitter and, at the same time, outputs the arbitrary signal to the real-time performance unit at the insertion timing associated with the first rhythm. According to the present invention, an arbitrary signal can be easily and accurately inserted in, for example, an acoustic sound of actual performance by a player, i.e. an acoustic sound of which rhythm is changeable at every performance or in the middle of the performance, at a predetermined desired timing.

Furthermore, for solving the aforementioned problems, the present invention is an arbitrary signal insertion system for inserting a transmittable arbitrary signal having a predetermined frequency into an acoustic sound at a desired insertion timing, comprising: an arithmetic unit which stores the insertion timing in association with a predetermined time code together with a preset first rhythm; a real-time performance unit for outputting an acoustic sound composed of a second rhythm actually performed by a player; and a peripheral device which receives the arbitrary signal inserted in the acoustic sound output from the real-time performance unit and is operated and controlled by insertion information included in the arbitrary signal; wherein the real-time performance unit has means for transmitting second rhythm information generated by actual performance to the arithmetic unit, and the arithmetic unit confirms that the second rhythm input from the real-time performance unit is synchronized with the first rhythm, and then outputs the arbitrary signal to the real-time performance unit at the insertion timing associated with the first rhythm.

According to the present invention, an arbitrary signal can be easily and accurately inserted in, for example, an acoustic sound of actual performance by a player, i.e. an acoustic sound of which rhythm is changeable at every performance or in the middle of the performance, at a predetermined desired timing.

In addition to the aforementioned features, the predetermined frequency is preferably an easily audible frequency (20 to 15 kHz) or a barely audible frequency (15 k to 20 kHz) within the human audible band (20 to 20 kHz).

Effects of the Invention

According to the present invention, for example, it is possible to easily and accurately insert an arbitrary signal into an acoustic sound at a predetermined desired timing even if the acoustic sound can be changed depending on player, time, and place like a music actually performed by a player.

BRIEF DESCRIPTION OF THE DRAWINGS

FIG. 4 is a waveform diagram showing a handclap produced by a percussion or the like.

EMBODIMENTS OF CARRYING OUT THE INVENTION

First Embodiment

A first embodiment according to the present invention will be described with reference to FIGS. 1 through 8.

[System Configuration]

Figure 1:
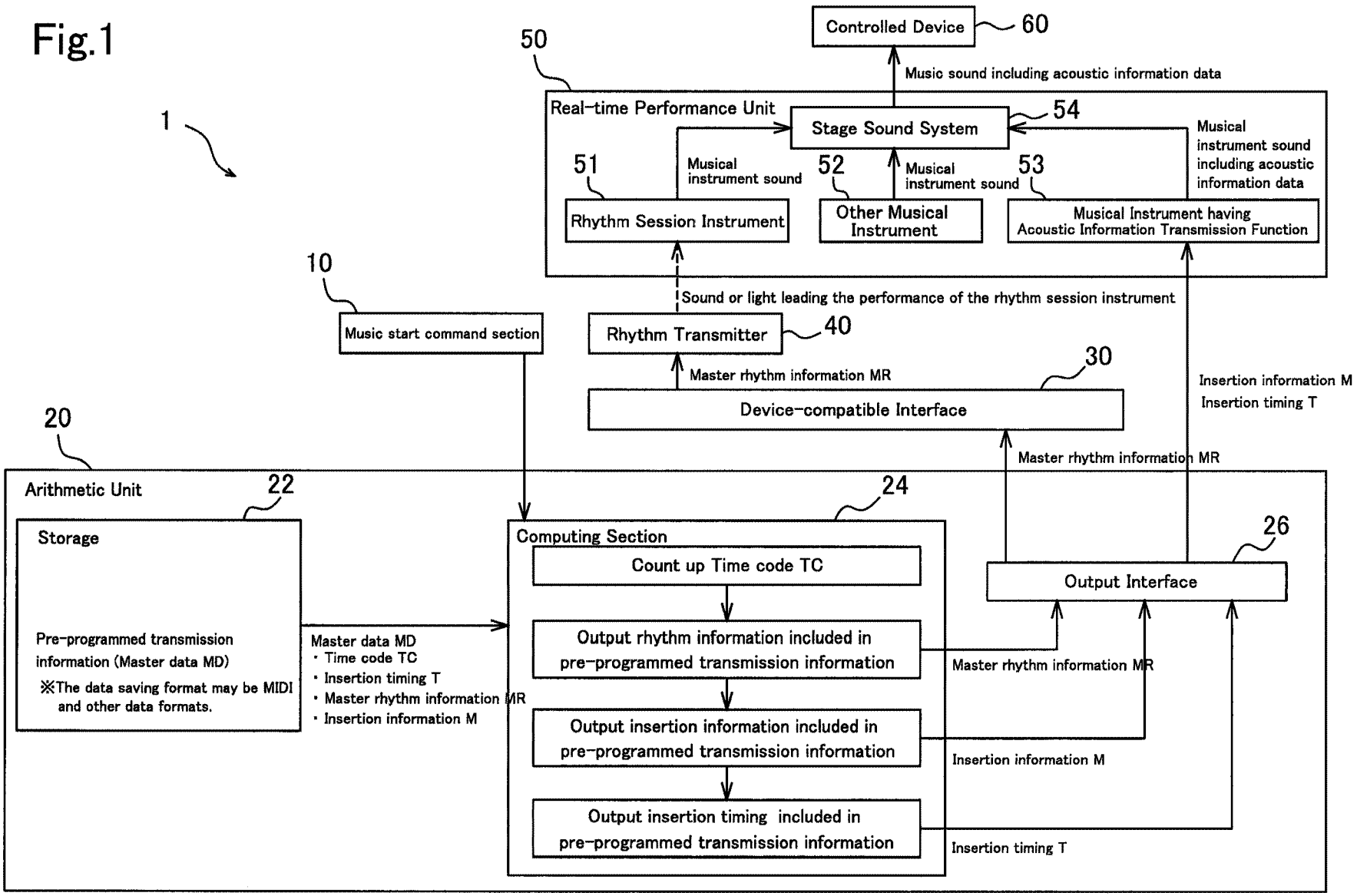
FIG. 1 is a block diagram showing a construction of an arbitrary signal insertion system 1.

First, description will be made with regard to a system construction of an arbitrary signal insertion system 1 used for implementing the first embodiment. As shown in FIG. 1, the arbitrary signal insertion system 1 comprises a music start command section 10, an arithmetic unit 20, a device-compatible interface 30, a rhythm transmitter 40, a real-time performance unit 50, and a controlled device 60.

The music start command section 10 is a part for commanding the arithmetic unit 20 to start the operation at the same time as the beginning of the music performance and is composed of a foot pedal or a keyboard, alternatively, a touch panel such as a liquid-crystal display, connected to the arithmetic unit 20. The command of the operation start is executed by a player or a PA engineer.

The arithmetic unit 20 is a part for implementing the execution procedure, of which details will be described later, based on a predetermined arithmetic processing, and comprises a storage 22, a computing section 24, and an output interface 26.

The storage 22 is a device for memorizing and storing pre-programmed transmission information (hereinafter referred to as "master data MD"), and is composed of, for example, a hard disk or an SSD.

Figure 2:
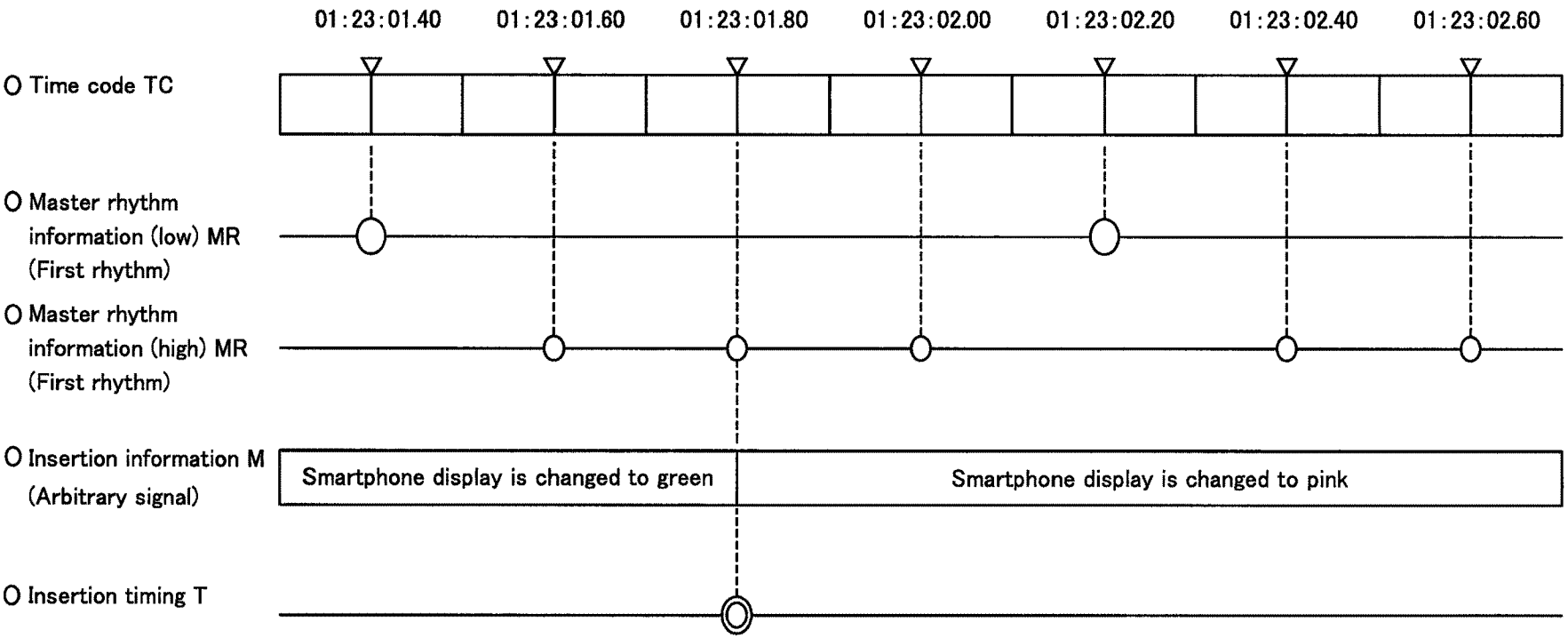
FIG. 2 is a diagram showing a time code and an insertion timing associated with the time code.

The master data MD comprises at least a time code TC, rhythm information of a music (hereinafter referred to as "master rhythm information MR". The master rhythm information MR corresponds to the "first rhythm" described in the claims.), insertion information for operating and controlling a peripheral device at a desired timing (hereinafter referred to as "insertion information M"), and information regarding the insertion timing (hereinafter referred to as "insertion timing T"). The insertion information M is composed of a transmittable arbitrary signal having a predetermined frequency, and at least the master rhythm information (high/low) MR and the insertion timing T are associated with the time code TC as shown in FIG. 2. The master data MD is in the form of, for example, MIDI (Musical Instruments Digital Interface) data, but may be in other data formats.

The time code TC is times of a clock (timer) belonging to the arithmetic unit 20 and is a parameter (index) for temporally managing various information such as the master rhythm information MR and the insertion timing T. The time code TC is time data at constant interval represented in hour-minute-second format in this embodiment, but alternatively a tempo reference note (eighth note, sixteenth note, or the like) may be used as a unit. Though the time code TC in hour-minute-second format in increments of 0.1 seconds is shown in FIG. 2, the time interval may be arbitrarily set. The master rhythm information MR in this embodiment includes high-pitch and low-pitch sounds. Generally, in a rhythm session instrument 51, for example, a drum set, the pitch is roughly divided into two types. For example, one is a low pitch that is produced by a bass drum or the like, and the other is a high pitch that is produced by a snare drum or the like. The high pitches and the low pitches make rhythms. The insertion timing T indicates the time for inserting the insertion information M in relation to the timing code TC. The insertion information M refers to information to be inserted into the music, and is inserted into the music at a time (01:23:01.80) indicated by a double circle of the insertion timing T.

The arbitrary signal may be a musical instrument sound to be played by the musical instrument 53 and having an acoustic information transmission function, described below, into which the insertion information M is inserted, or the insertion information M itself.

The computing section 24 uses a command from the music start command section 10 as a trigger and is configured to output the master rhythm information MR to the rhythm transmitter 40 after a lapse of a predetermined reference time ST and to output the insertion information M and the insertion timing T to the real-time performance unit 50 (more specifically, a musical instrument 53 having acoustic information transmission function described later) in accordance with an implementation procedure to be described later in detail. The computing section 24 comprises a CPU, a cache memory (main memory), and an operation program for executing the arithmetic processing stored in the cache memory (main memory). In the cache memory (main memory), for example, a sound editor (DAW) may be memorized and stored in advance, and the master data MD may be appropriately edited using the sound editor (DAW).

The output interface 26 is a member (connecting terminal) connecting an external device (more specifically, the rhythm transmitter 40 and the real-time performance unit 50) and the arithmetic unit 20 to output the master data MD (more specifically, the master rhythm information MR, the insertion information M, and the insertion timing T included in the master data MD) memorized and stored in the storage 22 in a predetermined data formation to the external device.

The device-compatible interface 30 is a member (connecting terminal) which enables transmission and reception of electrical signals between the arithmetic unit 20 (more specifically, the output interface 26 included in the arithmetic unit 20) and the rhythm transmitter 40. Through the device-compatible interface 30, the master rhythm information MR of the arithmetic unit 20 (more specifically, the master rhythm information MR memorized and stored in the storage 22 of the arithmetic unit 20) is outputted from the arithmetic unit 20 to the rhythm transmitter 40.

The rhythm transmitter 40 is a device which receives the master rhythm information MR (more specifically, the rhythm signal SR related to the master rhythm information MR) transmitted from the arithmetic unit 20 via the device-compatible interface 30, converts it into a predetermined form, and transmits (notifies) the converted information to the player and which is composed of an acoustic device such as a headphone or a speaker which transmits rhythm in the form of sound, or a lighting device which transmits rhythm in the form of light.

The real-time performance unit 50 is a part where the music is actually played by players or the like, and comprises a musical instrument group including a rhythm session instrument 51, other musical instruments 52 and a musical instrument 53 having an acoustic information transmission function, and a stage sound system 54.

The rhythm session musical instrument 51 is composed of a musical instrument suitable for keeping a rhythm such as drums and bass and creates sounds having a predetermined rhythm (hereinafter referred to as "rhythm R". The rhythm R corresponds to the "second rhythm" described in the claims.) through the player of the musical instrument. The player of the rhythm session instrument 51 senses a rhythm (rhythm of the master rhythm information MR) led by a sound or illumination transmitted through the rhythm transmitter 40 and is thus prompted to perform a rhythm in accordance with the rhythm of the master rhythm information MR, thereby achieving synchronization between the actual performance rhythm (second rhythm) and the rhythm (first rhythm) of the master rhythm information MR (this synchronization corresponds to "synchronization" described in the claims).

The other musical instrument 52 is a part for making the main melody of the music according to the rhythm generated by the rhythm session musical instrument 51, and includes, for example, a guitar and/or vocals.

The musical instrument 53 having the acoustic information transmission function is a part for receiving the insertion information M and the insertion timing T output from the arithmetic unit 20 through the output interface 26 and outputting the insertion information M and the insertion timing T to the stage sound system 54 and comprises, for example, a sampler or a synthesizer. The musical instrument 53 having the acoustic information transmission function has storage means, not shown, which stores the insertion information M and the like from the arithmetic unit 20. In a case where the insertion information M from the arithmetic unit 20 is a musical instrument sound in which the insertion information M is inserted, it is configured to output the musical instrument sound without any change when the insertion timing T of the insertion information M is received. On the other hand, in a case where the insertion information M from the arithmetic unit 20 is simply the insertion information M (in this case, the insertion information may be a search signal used for searching a musical instrument sound in which the insertion information M is inserted), the instrument sound in which the insertion information M is inserted is previously stored in the storage means (not shown). Then, when receiving the insertion information M (which may be the search signal) from the arithmetic unit 20, the musical instrument 53 searches for the musical instrument sound in which the insertion information M is inserted and stands ready. At a time when receiving the insertion timing T, the musical instrument 53 outputs the musical instrument sound.

The stage sound system 54 is a part which receives sounds (acoustic sounds) (more specifically, electrical signals related to the sounds (acoustic sounds)) generated from the rhythm session instrument 51, the other musical instruments 52, and the musical instrument 53 having the acoustic information transmission function, makes a single music (acoustic sound) composed of the plural sounds, and then emits it to the audience and the like, and comprises a mixer, a PA device, instrument individual amplifiers, and the like. The music includes insertion information M, and the controlled device 60 is remotely operated and controlled based on the insertion information M, as will be described later.

The controlled device 60 is a part which is remotely operated and controlled based on the insertion information M incorporated in the sound emitted from the real-time performance unit 50, more specifically, the music sound (acoustic sound) emitted from the stage sound system 54 constituting the real-time performance unit 50, and corresponds to the peripheral device described in the claims. The controlled device 60 is composed of, for example, a portable terminal (smartphone or the like) held by an audience.

[Implementation Procedure]

Figure 3:
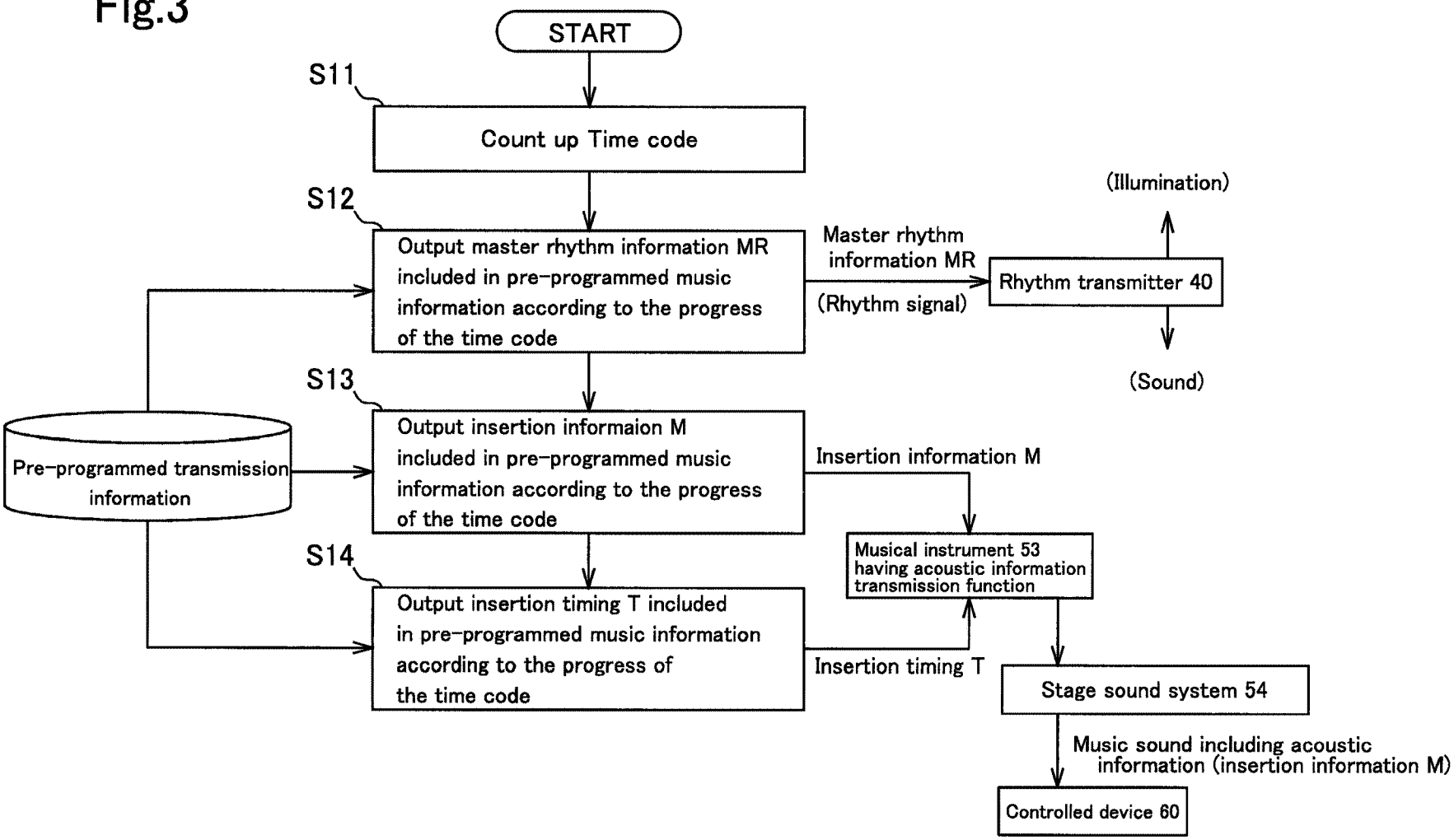
FIG. 3 is a flow chart showing procedures for carrying out an arbitrary signal insertion method.

Now, a specific procedure for implementing the first embodiment using the arbitrary signal insertion system 1 will be described with reference to FIGS. 1 through 3. As shown in FIG. 3, the specific procedure consists of a time-code counting up step S11 (hereinafter referred to as "counting up step S11"), a master rhythm information MR output step S12 (hereinafter referred to as "output step S12"), an insertion information M output step S13 (hereinafter referred to as "output step S13"), and an insertion timing T output step S14 (hereinafter simply referred to as "output step S14"). These steps are all executed by the computing section 24 of the arithmetic unit 20.

In the counting up step S11, the time code TC, that is, a time parameter (index) in which time at constant interval represented in hour-minute-second format (or a note as a benchmark for tempo (eighth note, sixteenth note, etc.)) is considered as one unit, is counted up using a timer. Specifically, the time corresponding to the one unit is measured by the timer, and the time code TC is cumulatively counted at a time interval corresponding to the one unit.

By executing this counting up step S11, the master rhythm information MR and the insertion timing T associated with the time code TC are managed on the time axis of the time code TC. Accordingly, in the following output steps S12, S13, and S14, these pieces of information can be output to the external device (specifically, the rhythm transmitter 40 and the real-time performance unit 50) at an appropriate timing.

When the counting up of the time code TC is started, the process proceeds to the master rhythm information MR output step S12. In this output step S12, the master rhythm information MR is output to the rhythm transmitter 40 through the output interface 26 and the device-compatible interface 30 at a time corresponding to the associated time code TC (1:23: 1.4, 1:23:1.6, and the like in the embodiment shown in FIG. 2).

The master rhythm information MR is not only composed of a single type of rhythm, but also composed of, for example, as described above, a plurality of types of rhythm information such as master rhythm information MR (low) with a low pitch and master rhythm information MR (high) with a high pitch, that is, may take various forms.

As described above, the rhythm transmitter 40, which is the output destination of the master rhythm information MR, is composed of, for example, an acoustic device such as a headset or a speaker that transmits rhythm as sound, or a luminaire that transmits rhythm with light. The player (more specifically, the player of the rhythm session instrument 51) senses the master rhythm information MR through sound (acoustic sound) or light emitted from the rhythm transmitter 40.

The player (more specifically, the player of the rhythm session instrument 51) who senses the master rhythm information MR through the rhythm transmitter 40 is encouraged to perform according to the rhythm included in the master rhythm information MR. As a result, the rhythm (second rhythm) actually performed and the rhythm (first rhythm) of the master rhythm information MR are synchronized.

Next, in the output step S13, the insertion information M (or the instrument sound into which the insertion information M is inserted, the same applies hereinafter) is output to the real-time performance unit 50 (the instrument 53 having the acoustic information transmission function) through the output interface 26. Then, in the output step S14, the insertion timing T of the insertion information M is output to the real-time performance unit 50 (the musical instrument 53 having the acoustic information transmission function) through the output interface 26.

Here, the insertion information M is transmitted to the musical instrument 53 having the acoustic information transmission function at a timing slightly before the time of the time code TC at which the insertion information M is inserted (emitted). On the other hand, the insertion timing T is transmitted to the musical instrument 53 having the acoustic information transmission function at the exact time of the time code TC at which the insertion information M is inserted (emitted). This is because of the following reason. When the data transmission speed of the output interface 26 and the signal processing capability of the musical instrument 53 having the acoustic information transmission function are both extremely high speed, the insertion information M may be output from the computing section 24 exactly at the time of the insertion timing. That is, in this case, the output of the insertion timing T from the computing section 24 is not necessary. However, the transmission speed of the output interface 26 to be used is generally not so high, and the signal processing capability of the musical instrument 53 having the acoustic information transmission function to be used (for example, for searching a musical instrument sound linked to the insertion information M) is also not so fast. Accordingly, if the insertion information M having a large amount of insertion information is output from the computing section 24 exactly at the time of the insertion timing, the emission should be delayed. On the other hand, since the insertion timing T can be a short signal, even if it is output from the computing section 24 exactly at the time of the insertion timing, the emission should not be delayed. Therefore, the insertion information M having a large amount of insertion information is output beforehand at a time slightly before the time code TC (1:23:1.8 in the embodiment shown in FIG. 2) to allow the instrument 53 having the acoustic information transmission function to prepare for emission, and the signal of the insertion timing T with a small amount of information is output at the exact emission timing (the above time, 1:23:1.8) so that the sound including the insertion information M (instrument sound including acoustic information data) is output from the instrument 53 having the acoustic information transmission function exactly at the output timing.

That is, the real-time performance unit 50 (the instrument 53 having the acoustic information transmission function) that has received the insertion timing T ejects the insertion information M as sound (instrument sound including acoustic information data) as described above. After the sound (instrument sound including acoustic information data) is organized into one musical sound (musical sound including acoustic information data) by the stage sound system 54 composed of a mixer or the like as described above, it is ejected to the audience at the concert hall, for example. The music sound includes insertion information M for remotely operating and controlling the controlled device 60 of a portable terminal (smartphone or the like) held by the audience.

The example shown in FIG. 2 illustrates a case in which the insertion information M is command information (control information) for lighting the display screen of the smartphone with a desired color. In this example, the smartphone held by the audience at the concert hall is remotely operated and controlled such that, for example, the display screen of the smartphone is changed from green to pink at a time (01:23:01.80) corresponding to the time code TC associated with the insertion timing T. In addition to the above, the command information based on the insertion information M may command the plurality of smartphones (peripheral devices) to operate respectively depending on their specific information, for example, to change display screens of women's smartphones to pink and change display screens of men's smartphones to green. Moreover, it may command such smartphones to perform various actions such as vibrating, displaying a desired advertisement on the display screen, and ejecting a desired sound.

[Method for Inserting Arbitrary Signal (Insertion Information M) into Instrument Sound (Method for Generating Acoustic Information)]

Now, an example of a method for inserting an arbitrary signal (more specifically, the insertion information M) into an instrument sound in the musical instrument 53 (specifically a sampler) having the acoustic information transmission function will be described with reference to FIGS. 4 through 8. The insertion information M is inserted into the music (acoustic sound composing the music) in the form of sound (acoustic sound) of a predetermined frequency. The frequency is preferably within the human audible band (20 to 20 kHz). This is because, in order to make effective use of the present invention, it is desirable to effectively use existing systems handling "sounds" (radio, television, music player, etc.) and almost all of these existing systems are designed to output sounds of the audible band mainly.

Here, it is considered that the upper limit of the sound that can be recognized as a meaningful sound by an adult with a standard physique is 15 kHz. That is, in many people, the sound of 20 to 15 kHz is in a frequency range that is easily audible (hereinafter referred to as "easily audible frequency range"), while the sound of 15 k to 20 kHz is in a frequency range that is difficult to hear (hereinafter referred to as "barely audible frequency range"). Therefore, in the present invention, the human audible band (20 to 20 kHz) is classified into the easily audible range and the barely audible range, and an insertion method suitable for each range will be described below.

In the method of inserting the insertion information M using the sound (acoustic sound) having a frequency in the easily audible range, it is required to insert the information by a method that hardly affects the atmosphere (quality) of the original sound. As an example of such a method, there is "TRANSMISSION METHOD OF ARBITRARY SIGNAL USING SOUND" (hereinafter referred to as "insertion method 1") described in Japanese Patent Application No. 2014-74180 (JP2015197497A).

In the insertion method 1, the waveform forming the sound is separated into an essential part (essential sound) that mainly contributes to sound recognition and an accompanying part (accompanying sound) that incidentally contributes to sound recognition. An arbitrary signal composing the insertion information M is inserted in place of the accompanying sound. Here, since the accompanying sound is hidden under the essential sound in sound recognition, even if it is replaced with an arbitrary signal, the atmosphere (quality) of the original sound is not substantially affected.

Figure 4:
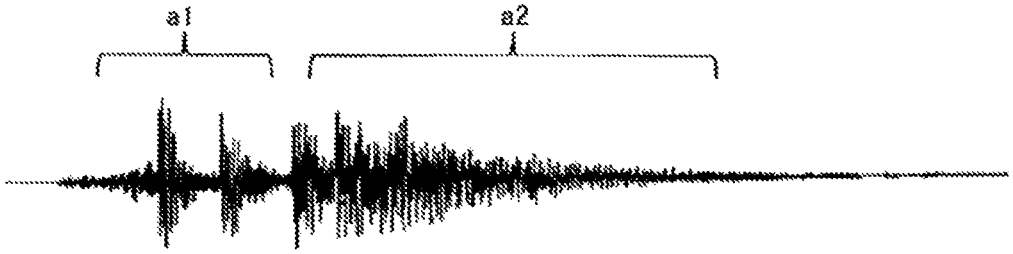
Figure 5:
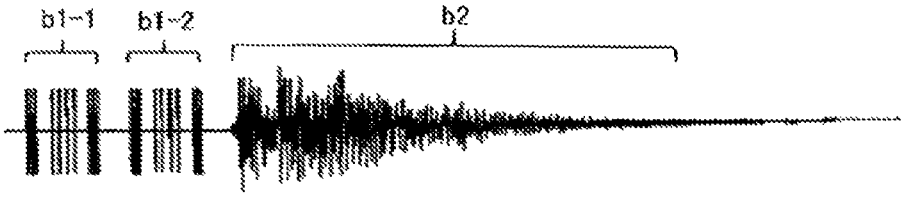
FIG. 5 is a waveform diagram showing an example of handclap, produced by the percussion or the like, to which an arbitrary signal is inserted.

For example, in a hand clap sound generated by a percussion instrument or the like, a long waveform a2 appears after a few successive waveforms a1 similar to an impulse response of about 11 ms period, as shown in FIG. 4. The inventor of the present invention has confirmed that the waveform a1 is a portion that has a continuous time of about several ms and should be heard as a sound with no musical pitches. This waveform a1 corresponds to the accompanying sound (hereinafter referred to as "accompanying sound a1"), and the long waveform a2 following the waveform a1 corresponds to the essential sound (hereinafter referred to as "essential sound a2"). In the first embodiment, an arbitrary signal (hereinafter referred to as "arbitrary signal b1") is inserted in place of the accompanying sound a1. The arbitrary signal b1 is a sound having a predetermined frequency composing the insertion information M. FIG. 5 shows an embodiment in which the accompanying sound a1 is replaced with the arbitrary signal b1 based on the hand clap sound generated by a percussion instrument or the like, similarly to the aforementioned example. In this embodiment, the arbitrary signal b1 is composed of a plurality of arbitrary signals b-1 and b-2. It should be noted that general sampling sounds are hand clap sounds and short sound effects, and are often used as complementary sounds in terms of rhythm timing rather than playing the main melody of the music so that such arbitrary signals can be easily inserted by the method mentioned above and are thus preferable.

Now, a process of generating the insertion information M as information included in the master data MD according to the insertion method 1 will be described with reference to FIG. 6.

Figure 6:
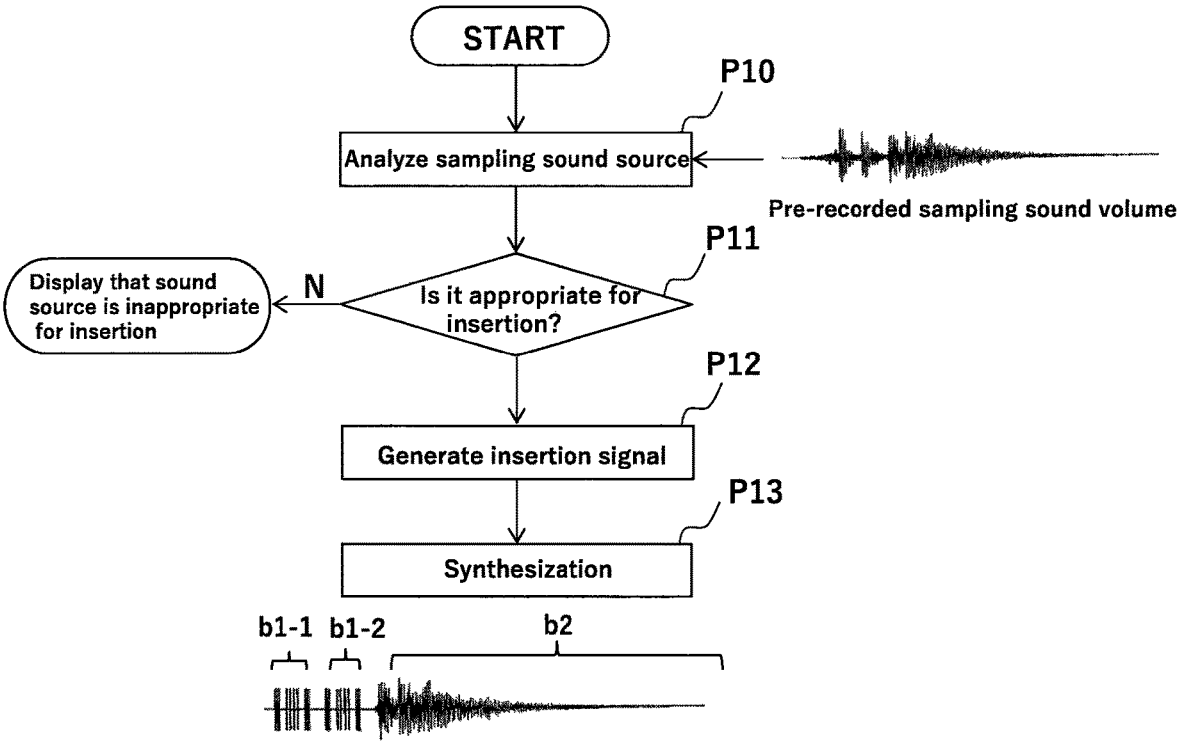
FIG. 6 is a flow chart showing an insertion process of insertion information.

In the process shown in FIG. 6, a sampling sound source is first recorded from the musical instrument 53 having the acoustic information transmission function, and the sampling sound source is analyzed (process P10). Specifically, according to the insertion method 1, the sampling sound source is categorized and separated into the essential sound a2 and the accompanying sound a1.

Based on the analysis result performed in the process P10, it is determined whether or not the sampling sound source is appropriate for inserting an arbitrary signal composing the insertion information M (process P11).

When it is determined in process P11 that the sampling sound source is appropriate for inserting an arbitrary signal constituting the insertion information M, an insertion signal forming the main part of the insertion information M is generated (process P12). This insertion signal corresponds to the arbitrary signal b1 (hereinafter referred to as "insertion signal b1") in the description of the insertion method 1 and is configured as a sound with an easily audible frequency (20 to 15 kHz) in the human audible band (20 to 20 kHz) as described above. When it is determined in process P11 that the sampling sound source is inappropriate for inserting an arbitrary signal composing the insertion information M, a message to that effect is displayed to the operator.

When the insertion signal b1 is generated in the process P12, the insertion signal b1 and a pre-recorded sampling sound source are synthesized according to the insertion method 1 (process P13). Specifically, the essential sound a2 is left as it is (the synthesized essential sound is referred to as the essential sound b2 for convenience), and the accompanying sound a1 is replaced with the insertion signal b1 (b1-1 and b1-2). As a result, insertion information M composed of the insertion signal b1 (b1-1 and b1-2) and the essential sound b2 is generated.

The insertion information M generated by the processes P10 through P13 is recorded and stored in the storage 22 of the arithmetic unit 20 or the storage means of the musical instrument 53 having the acoustic information transmission function as described above.

According to the insertion method 1, using of the easily audible frequency with a wide band enables insertion of more information and does not affect the original sound atmosphere (quality).

As another method of inserting the insertion information M using sound (acoustic sound) having a frequency in the easily audible range, there is a method (hereinafter referred to as "insertion method 2") in which the insertion signal b1 forming the main part of the insertion information M is actively used as a part of the sounds (acoustic sound) constituting the music. For example, the chord sound corresponding to the insertion signal b1 is used as a meaningful sound such as a sound effect.

Figure 7:
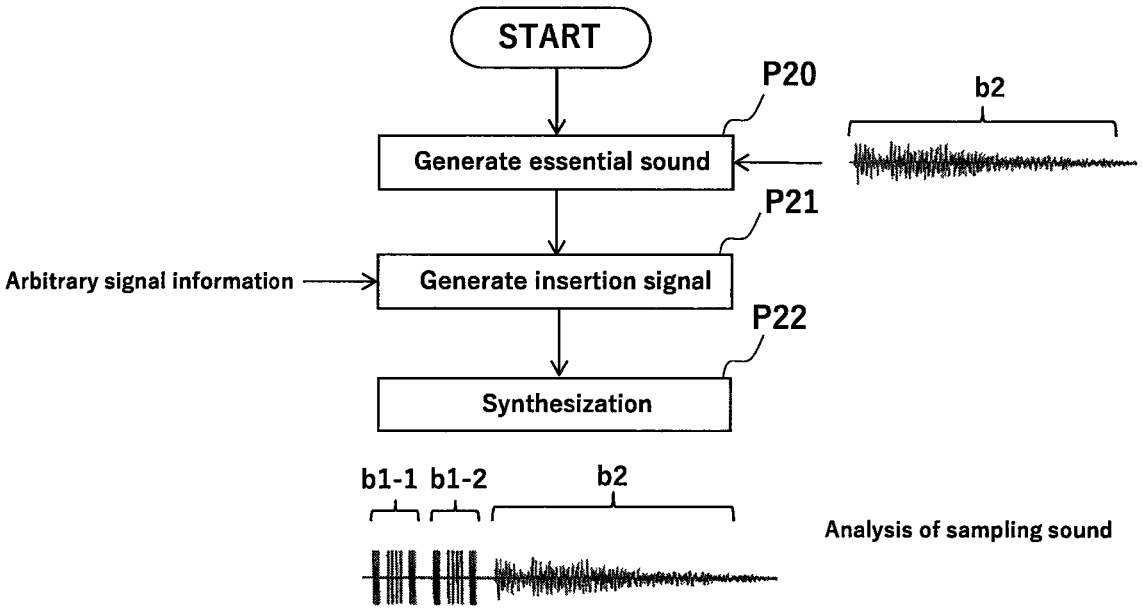
FIG. 7 is a flow chart showing an insertion process of insertion information.

An implementation process of the insertion method 2 is shown in FIG. 7. In this process, first, an appropriate essential sound b2 is created or an appropriate one is selected from various sampling sound sources and used as the essential sound b2 (process P20).

Next, the insertion signal b1 (b1-1 and b1-2) forming the main part of the insertion information M is generated (process P21). At this time, as described above, the insertion signal b1 is a sound that is meaningful in music, such as a sound effect composed of a sound with an easily audible frequency in the range of 20 to 15 kHz. That is, in this example, the insertion information M forms a part of the music.

After that, the essential sound b2 generated in the process P20 and the insertion signal b1 generated in the process P21 are synthesized (process P22). Thereby, the insertion information M composed of the insertion signal b1 and the essential sound b2 is generated.

The insertion information M generated through the processes P20 to P22 is recorded and stored in the storage 22 of the arithmetic unit 20 or the storage means of the musical instrument 53 having the acoustic information transmission function, as is the case with the insertion method 1.

On the other hand, as a method of inserting the insertion information M using the sound (acoustic sound) having a frequency in the barely audible range, the insertion method 1 or 2 may be used. However, since it is inherently difficult to identify such sound as a meaningful sound (acoustic sound), it is not strictly required to compose the inserted sound as a concealed sound or a meaningful sound. Therefore, the insertion may be implemented by a method (hereinafter referred to as "insertion method 3") in which the insertion information M is just added to an audio sound composing a music at a desired timing (insertion timing T).

Figure 8:
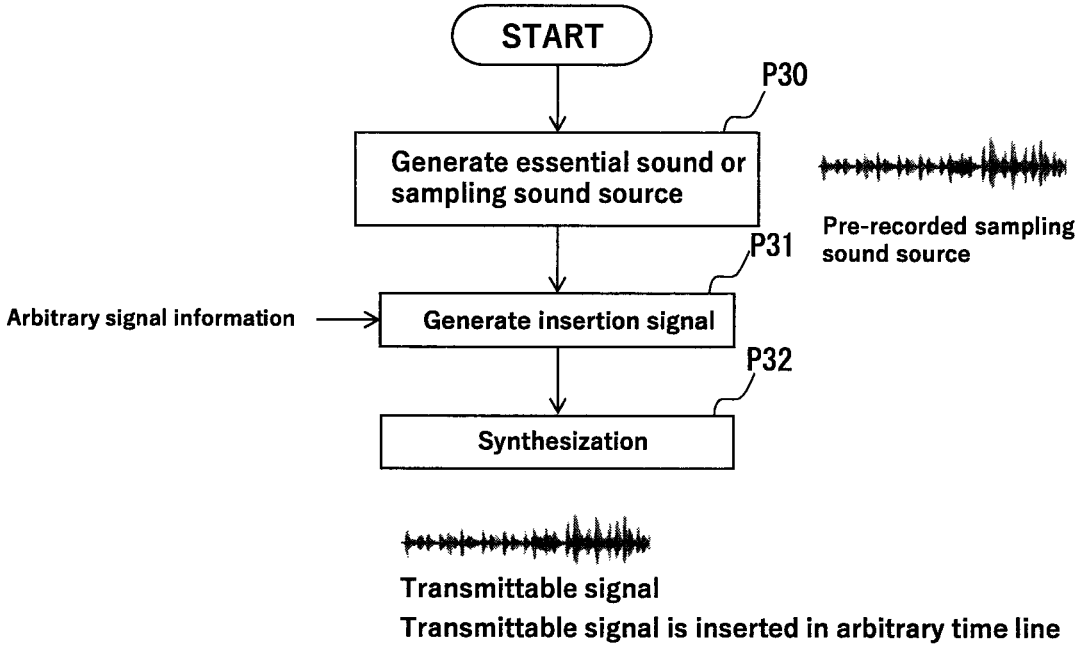
FIG. 8 is a flow chart showing an insertion process of insertion information.

An implementation process of the insertion method 3 is shown in FIG. 8. In this process, first, an appropriate essential sound is created or an appropriate one is selected from various sampling sound sources and used as the essential sound (process P30). It should be noted that the sampling sound source may include the same frequency as the insertion signal (the carrier frequency of the insertion information M). Therefore, when using the sampling sound source as the essential sound, it is preferable to preliminarily remove carrier frequency by using a filter. In addition, even for frequency components that do not contribute to audible sound, it also requires attention not to saturate the level.

Then, an insertion signal forming the main part of the insertion information M is generated (process P31). At this time, as described above, the insertion signal is composed of a sound with a barely audible frequency in the range of 15 k to 20 kHz.

The essential sound generated in the process P30 and the insertion signal generated in the process P31 are synthesized (process P32). Accordingly, the insertion information M composed of the insertion signal and the essential sound is generated.

The insertion information M generated through the processes P30 to P32 is recorded and stored in the storage 22 of the arithmetic unit 20 or the storage means of the musical instrument 53 having the acoustic information transmission function, similarly to the insertion methods 1 and 2.

Since, in the insertion method 3, it is not strictly required to conceal the insertion sound or to configure the insertion sound as a meaningful sound like in the insertion methods 1 and 2, the insertion method 3 allows increase of the degree of freedom in configuration and thus allows simplification of the configuration and diversification of the rendition.

According to the first embodiment described above, the player performs with the rhythm according to the master rhythm information MR included in the pre-programmed transmission information, so the master rhythm information MR and the rhythm actually played are synchronized. As a result, it is possible to easily insert the arbitrary signal, which can be transmitted to control the controlled device 60, into an acoustic sound composed of a rhythm that can be changed depending on the player, the time, and the place at a predetermined desired timing.

Second Embodiment

A second embodiment according to the present invention will be described with reference to FIGS. 9 through 13. It should be noted that the same reference numerals or symbols as those in the first embodiment denote the same concepts as in the first embodiment unless otherwise specified.

[System Configuration]

Figure 9:
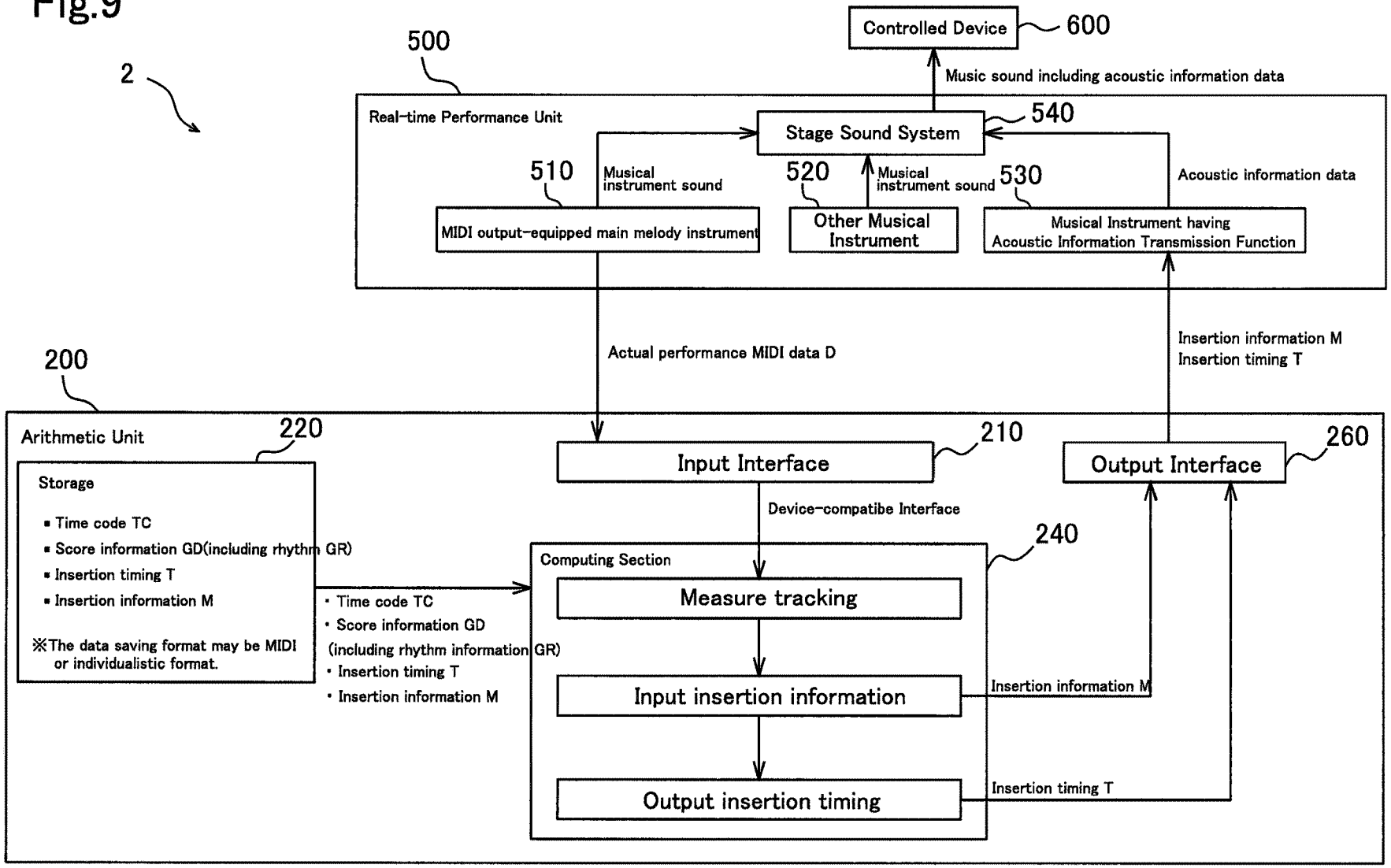
FIG. 9 is a block diagram showing a construction of an arbitrary signal insertion system 2.

As shown in FIG. 9, the arbitrary signal insertion system 2 used in the second embodiment is mainly composed of devices such as an arithmetic unit 200, a real-time performance unit 500, and a controlled device 600.

The arithmetic unit 200 is a part for implementing an execution procedure, of which details will be described later, based on a predetermined arithmetic processing, and mainly comprises an input interface 210, a storage 220, a computing section 240, and an output interface 260.

The input interface 210 is a part for receiving, for example, actual performance MIDI data D in the MIDI data format from the real-time performance unit 500 (more specifically, an MIDI output-equipped main melody instrument 510 described later).

Figure 10:
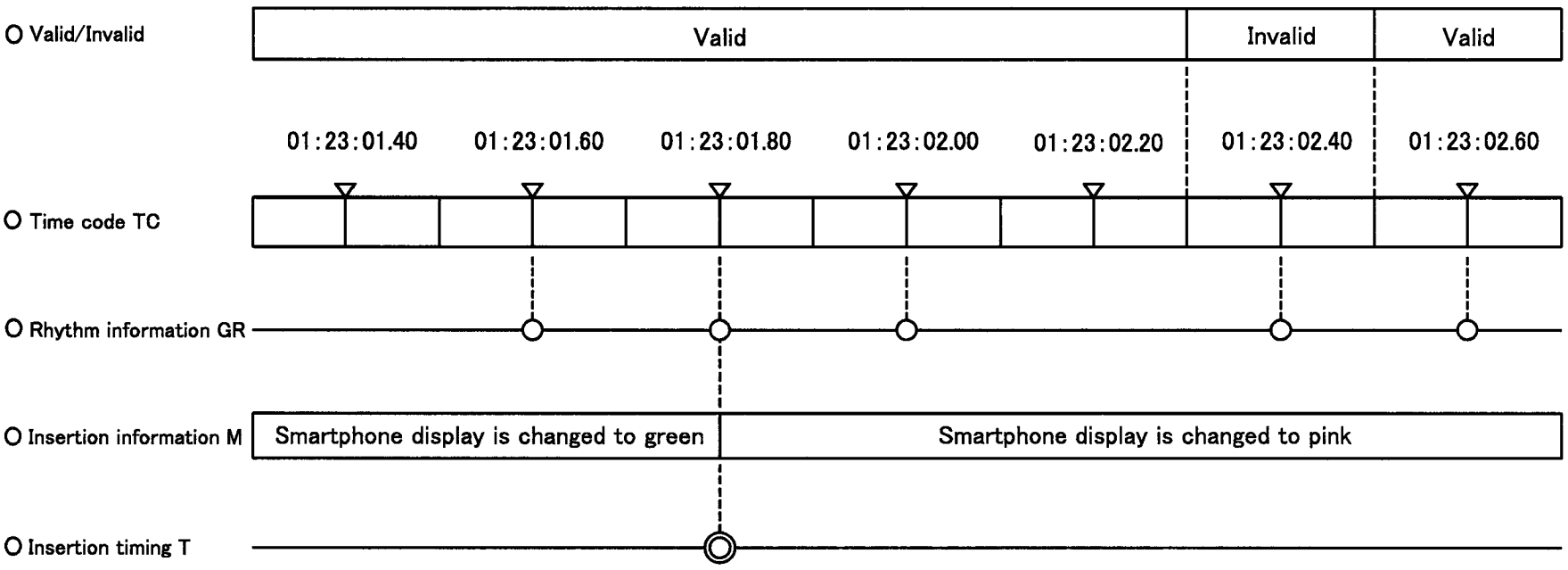
FIG. 10 is a diagram showing a time code and an insertion timing associated with the time code.

The storage 220 memorizes and stores a time code TC, score information of a prerecorded music (hereinafter, referred to as "score information GD"), insertion information M (insert information M itself or musical instrument sound for the musical instrument 530 having the acoustic information transmission function in which the insertion information M is inserted), and the insertion timing T, etc. and is composed of, for example, a hard disk or an SSD. The score information GD is obtained by prerecording the MIDI signal data of the MIDI output-equipped main melody responsible instrument 510 described below, for example, at a rehearsing, and includes at least rhythm information GR. The rhythm information GR and the insertion timing T are associated with the time code TC as shown in FIG. 10. These various types of information take the form of, for example, a MIDI data format, but may be in other data formats. The time code TC has the same concept as the time code TC of the first embodiment.

The computing section 240 is a part which extracts the insertion timing T appropriate for inserting the insertion information M by executing score tracking according to the execution procedure, of which details will be described later, and outputs the extracted insertion timing T and the insertion information M to an external device (more specifically, a musical instrument 530 having acoustic information transmission function of the real-time performance unit 500 described later), and comprises a CPU, a cache memory (main memory), and an operation program for executing the score tracking stored in the cache memory (main memory).

The output interface 260 is a part for electrically connecting the external device and the arithmetic unit 200 in order to output the insertion information M and the insertion timing T recorded and stored in the storage 220 to the external device (more specifically, the musical instrument 530 having the acoustic information transmission function) in the form of predetermined data format.

The real-time performance unit 500 is a part which generates a musical sound composed of a musical instrument sound played in real time by players and a musical instrument sound including acoustic information data into which insertion information M, which will be described later, is inserted, and emits the musical sound to the outside. The real-time performance unit 500 mainly comprises a musical instrument group including the MIDI output-equipped main melody instrument 510, other musical instrument 520, and the musical instrument 530 having an acoustic information transmission function, and a stage sound system 540.

The MIDI output-equipped main melody instrument 510 is a part which plays the main melody of the music and, as described above, is a part which outputs the actual performance MIDI data D to the computing section 240 through the input interface 210 of the arithmetic unit 200. The MIDI output-equipped main melody instrument 510 is composed of a musical instrument such as a guitar with MIDI output.

The other musical instruments 520 are composed of musical instruments and vocals that make a music together with the MIDI output-equipped main melody instrument 510, and rhythm session instruments such as bass and drums that produce predetermined rhythm.

The musical instrument 530 having the acoustic information transmission function is a part which receives the insertion information M and the insertion timing T (more specifically, the respective electrical signals related to the insertion information M and the insertion timing T) output from the arithmetic unit 200 through the output interface 260 and outputs an instrument sound including the acoustic information data in which the insertion information M is inserted at the insertion timing, and is composed of, for example, a sampler or a synthesizer. The musical instrument 530 having the acoustic information transmission function also has storage means and functions similar to those of the musical instrument 53 having the acoustic information transmission function. That is, the insertion information M and the like received from the arithmetic unit 200 are stored in the storage means. Further, in case where the insertion information M received from the arithmetic unit 200 is a musical instrument sound in which the insertion information M is inserted, the musical instrument sound is output as it is when the insertion timing T of the insertion information M is received. On the other hand, in case where the insertion information M received from the arithmetic unit 200 is only the insertion information M (in this case, the insertion information may be a search signal used to search for a musical instrument sound in which the insertion information M is inserted), the instrument sound in which the insertion information M is inserted is previously stored in the storage means (not shown). Then, when receiving the insertion information M (which may be the search signal) from the arithmetic unit 200, the musical instrument 530 searches for the musical instrument sound in which the insertion information M is inserted and stands ready. At a time when receiving the insertion timing T, the musical instrument 530 outputs the musical instrument sound.

The stage sound system 540 is a part which receives the musical instrument sound, made by the MIDI output-equipped main melody instrument 510 and the other musical instrument 520, and the musical instrument sound including the acoustic information data generated by the musical instrument 530 having the acoustic information transmission function (more specifically, electrical signals related to these sounds (acoustic sounds)), composes one music sound (music information) from these plural instrument sounds, and ejects the composed music sound to the audience and the like. The stage sound system 540 is composed of a mixer, a PA device, and an amplifier individualized for each musical instrument. The music sound includes insertion information M, and the controlled device 600 is remotely operated and controlled based on the insertion information M, similarly to the first embodiment. The insertion information M is incorporated into the music sound in the form of a signal (sound) in the easily audible frequency range or the barely audible frequency range as the acoustic information data by the method described in the first embodiment.

The controlled device 600 is a part which is remotely operated and controlled based on the insertion information M incorporated in the sound (music information) emitted from the stage sound system 540, similarly to the controlled device 60 of the first embodiment. The controlled device 600 is composed of, for example, a portable terminal (smartphone or the like) held by an audience.

[Implementation Procedure]

Figure 11:
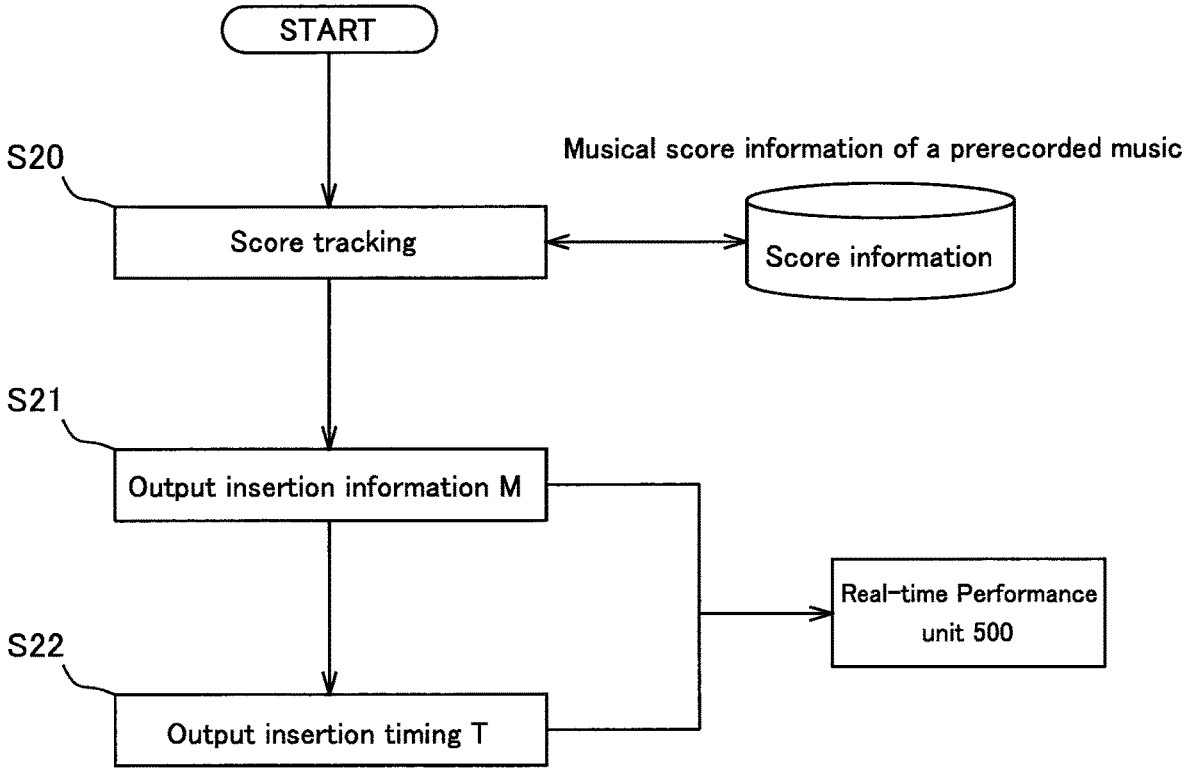
FIG. 11 is a flow chart showing procedures for carrying out an arbitrary signal insertion method.

Now, a specific procedure for executing the second embodiment using the arbitrary signal insertion system 2 will be described. As shown in FIG. 11, the specific procedure includes a score tracking step S20, an insertion information output step S21, and an insertion timing output step S22.

The score tracking step S20 is a step of tracking the musical score, that is, comparing the score information of prerecorded music with the music information played in real time using the time code TC as a time axis.

As a method of tracking the musical score in real time, there are a method using a MIDI signal and a method using a general-purpose instrument sound. In the following description, the method using a MIDI signal, which is more practical, will be explained.

Figure 12:
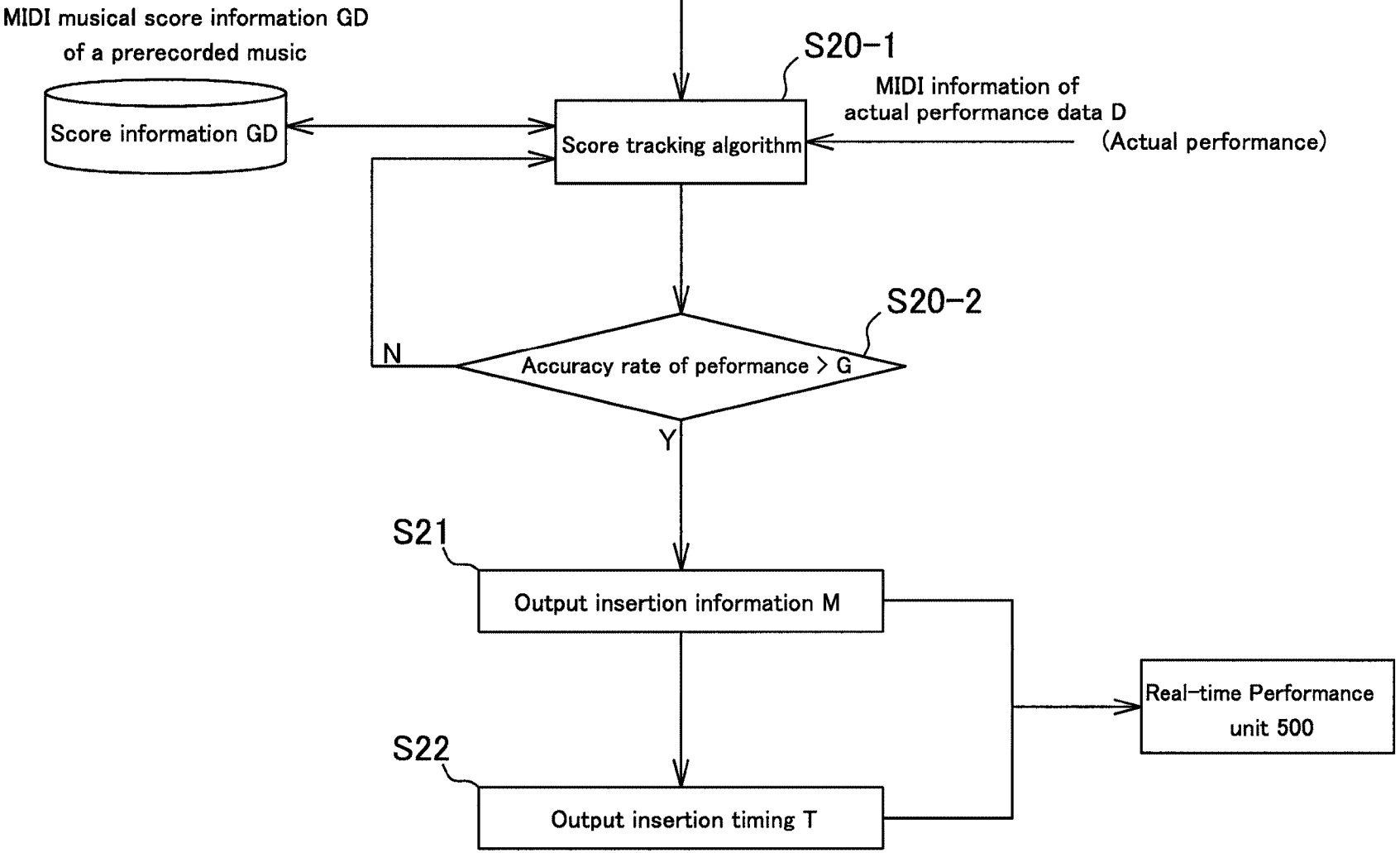
FIG. 12 is a flow chart showing procedures of tracking a musical score using a MIDI signal.

FIG. 12 is a diagram illustrating an embodiment of the method for tracking the musical score using the MIDI signal. In this embodiment, the score information GD and the actual performance data D are both MIDI format data, and the respective pieces of rhythm information contained in these two data are collated with each other (step S20-1). Next, it is determined with a note (measure) as one unit whether or not the rhythm information included in the score information GD effectively tracks the rhythm information included in the actual performance data D (step S20-2).

For instance, the collation in the step S20-1 is executed as follows. The rhythm information GR (first rhythm) included in the score information GD and the rhythm information R2 (second rhythm) included in the actual performance data D are collated with each other in a predetermined note group (measure) unit.

The determination in the step S20-2 uses, for example, Dannenberg's DP (dynamic programming) matching method. In this DP matching method, a correct rate g of the score tracking algorithm is calculated in the note group (measure) unit. When the correct rate g is equal to or greater than a predetermined threshold G, the note group (measure) is judged as effective. The threshold G can be changed according to the importance of the insertion information M. For example, a small value is set when you can allow for a certain amount of error of the transmission timing or the like, and an increased value is set when the content is important, such as sponsor information (it is better not to transmit it than to transmit erroneous information).

The accuracy rate g of the score tracking algorithm is calculated as follows. In a state that the rhythm information GR included in the musical score information GD and the rhythm information R2 in the actual performance data D in the predetermined note group (measure) are associated with the same timeline (same time code), the time difference $\Delta t$ between them is measured by a timer (hardware clock or the like) of the arithmetic unit 200. When the time difference $\Delta t$ is equal to or smaller than a predetermined threshold T, it is determined to be valid in a single note group (measure), and when it is larger than the threshold T, it is determined to be invalid in a single note group (measure). This is repeated by the number of note groups (measures) included in the predetermined time (hereinafter referred to as "determination number N"). Accuracy rate g is a percentage obtained by dividing the number n of times of determination to be valid in the single note group (measure) by the determination number N. That is, the accuracy rate g is defined by the equation $g=n/N\times100(\%)$. When the accuracy rate g is equal to or greater than a predetermined threshold G, it is determined to be valid in the step S20-2, and when it is less than the threshold G, it is determined to be invalid in the step S20-2.

When it is determined to be valid in the score tracking step S20 (more specifically, step S20-2), the process proceeds to an insertion information output step S21 and an insertion timing output step S22. On the other hand, when it is determined to be invalid in the score tracking step S20 (more specifically, step S20-2), the process returns to the step S20-1.

In the insertion information output step S21, according to the progress of the time code TC, the corresponding insertion information M (or instrument sound in which the insertion information M is inserted, the same applies hereinafter) is sent to the real-time performance unit 500 (specifically, the musical instrument 530 having the acoustic information transmission function). In the insertion timing output step S22, the corresponding insertion timing T is output to the real-time performance unit 500 (specifically, the musical instrument 530 having the acoustic information transmission function) as the time code TC progresses. It should be noted that the timings for transmitting the insertion information M and the insertion timing T to the musical instrument 530 having the acoustic information transmission function are the same as those of the aforementioned first embodiment. The musical instrument 530 having the acoustic information transmission function that has received the insertion timing T emits a musical instrument sound including the acoustic information data toward the audience or the like through the stage sound system 540.

As described above, in the second embodiment, for example as shown in FIG. 10, it is determined whether or not the rhythm information GR of the musical score information GD of a prerecorded music effectively tracks (synchronizes) the rhythm information R2 of the actual performance data D of the same music. When the information effectively tracks (synchronizes or valid in FIG. 10), the insertion information M is emitted at the insertion timing T if exists. On the other hand, when the information does not track effectively (not synchronizes or invalid in FIG. 10), the insertion information M is not emitted.

In the method for obtaining the insertion timing T by musical score tracking in the second embodiment, unlike the method for obtaining the insertion timing while constantly synchronizing the rhythm with the sound and illumination from the rhythm transmitter 40 as in the first embodiment, it is predicted that the rhythm will be synchronized even after the rhythm is determined to be synchronized and the insertion timing after the determination of synchronization is determined based on the prediction (in other words, the effectiveness of the future insertion timing T is predicted from the determination result of effectiveness in the past). The validity of the prediction of the insertion timing is secured by the experimental results described below.

Figure 13:
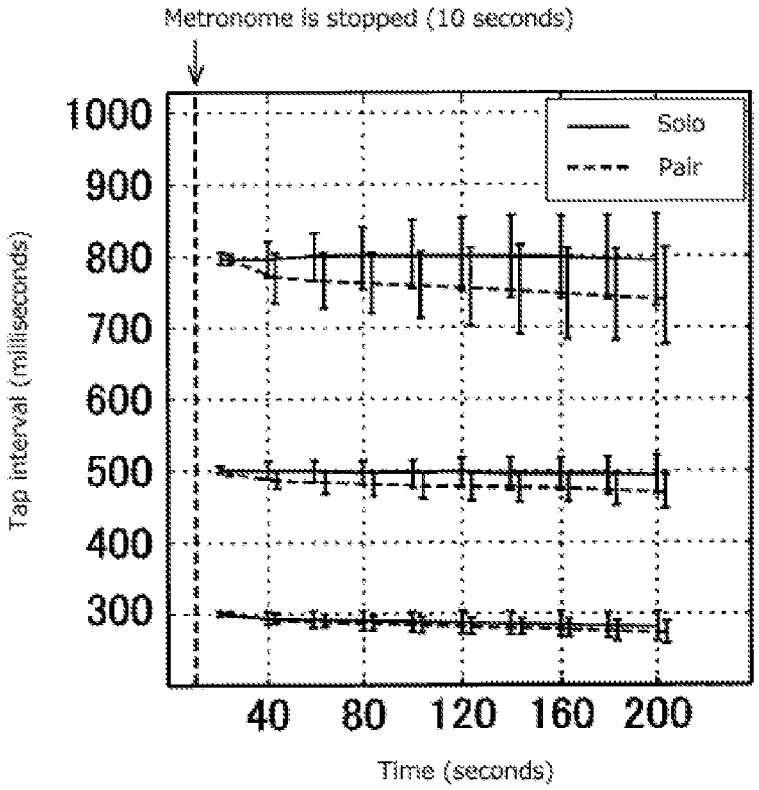
FIG. 13 is a diagram showing experimental data to be used as references for providing determination conditions of insertion timing.

That is, the experiment conducted with 24 adults (12 pairs) for the purpose of logically evaluating the phenomenon in which the tempo of performance gets faster (running), as shown in FIG. 13, confirmed that human ability of maintaining rhythm is high. The results shown in FIG. 13 prove that the rhythm is relatively accurately kept for 40 seconds after a standard rhythm reference (metronome) is stopped and that the rhythm can be almost exactly kept especially immediately after the stop.

According to the experimental results shown in FIG. 13, the insertion timing T existing in a period of 40 seconds at most after it is determined that the rhythm is synchronized with the actual performance, that is, the insertion timing T existing in a period of 40 seconds after it is determined to be valid in the score tracking step S20 (more specifically, step S20-2) can be construed as the timing under the condition that the rhythms included in the score information GD and the actual performance MIDI data D are synchronized.

As mentioned above, although the embodiment of the invention made by the present inventor has been specifically described, the present invention is not limited to the aforementioned embodiments and various modifications can be made without departing from the scope of the invention.

EXPLANATION OF REFERENCES

1: arbitrary signal insertion system
2: arbitrary signal insertion system
10: music start command section (start command section)
20: arithmetic unit
22: storage
24: computing section
26: output interface
30: device-compatible interface
40: rhythm transmitter
50: real-time performance unit
51: rhythm session instrument
52: other musical instrument
53: musical instrument having acoustic information transmission function
54: stage sound system
60: controlled device
200: arithmetic unit
210: input interface
220: storage
240: computing section
260: output interface
500: real-time performance unit
510: MIDI output-equipped main melody instrument
520: other musical instrument
530: musical instrument having acoustic information transmission function
540: stage sound system
600: controlled device
MD: master data
MR: master rhythm information (first rhythm)
D: actual performance data
R: rhythm (second rhythm)
M: insertion information

What is claimed is:

1. An arbitrary signal insertion method for inserting a transmittable arbitrary signal having a predetermined frequency into an acoustic sound at a desired insertion timing, wherein the insertion timing is previously associated with a predetermined time code together with a first rhythm, the acoustic sound is composed of a plurality of sounds with a second rhythm, and the arbitrary signal is inserted into the acoustic sound at the insertion timing after the first rhythm and the second rhythm are synchronized, wherein the second rhythm is an acoustic rhythm actually played by a player, and synchronization between the first rhythm and the second rhythm is achieved by notifying the player to play the second rhythm based on of the rhythm information related to the first rhythm.

2. An arbitrary signal insertion method as claimed in claim 1, wherein the arbitrary signal inserted into the acoustic sound includes at least insertion information for operating and controlling a peripheral device to perform a predetermined operation.

3. An arbitrary signal insertion method according to claim 2, wherein the peripheral device comprises a plurality of peripheral devices, and the insertion information is configured to command the peripheral devices to perform different operations depending on respective specific information of the peripheral devices.

4. An arbitrary signal insertion method for inserting a transmittable arbitrary signal having a predetermined frequency into an acoustic sound at a desired insertion timing, wherein the insertion timing is previously associated with a predetermined time code together with a first rhythm, the acoustic sound is composed of a plurality of sounds with a second rhythm, and the arbitrary signal is inserted into the acoustic sound at the insertion timing after the first rhythm and the second rhythm are synchronized, wherein the second rhythm is an acoustic rhythm actually played by a player, and after it is confirmed that the second rhythm is synchronized with the first rhythm, the arbitrary signal is inserted into the acoustic sound at the insertion timing, wherein the synchronization is confirmed by comparing the second rhythm included in MIDI data related to the actually played acoustic sound with the first rhythm included in the MIDI data related to musical score information of a prerecorded acoustic sound.

5. An arbitrary signal insertion system for inserting a transmittable arbitrary signal having a predetermined frequency into an acoustic sound at a desired insertion timing, comprising:

an arithmetic unit which stores the insertion timing in association with a predetermined time code together with a preset first rhythm;

a start command section for commanding the arithmetic unit to start performance;

a real-time performance unit for outputting an acoustic sound composed of a second rhythm actually performed by a player;

a rhythm transmitter for emitting rhythm information of the acoustic sound to the player of the real-time performance unit; and a peripheral device which receives the arbitrary signal inserted in the acoustic sound output from the real-time performance unit and is operated and controlled by insertion information included in the arbitrary signal, wherein the arithmetic unit outputs the first rhythm to the rhythm transmitter and, at the same time, outputs the arbitrary signal to the real-time performance unit at the insertion timing associated with the first rhythm.

6. An arbitrary signal insertion system for inserting a transmittable arbitrary signal having a predetermined frequency into an acoustic sound at a desired insertion timing, comprising:

an arithmetic unit which stores the insertion timing in association with a predetermined time code together with a preset first rhythm;

a real-time performance unit for outputting an acoustic sound composed of a second rhythm actually performed by a player; and a peripheral device which receives the arbitrary signal inserted in the acoustic sound output from the real-time performance unit and is operated and controlled by insertion information included in the arbitrary signal; wherein the real-time performance unit has means for transmitting second rhythm information generated by actual performance to the arithmetic unit, and the arithmetic unit confirms that the second rhythm input from the real-time performance unit is synchronized with the first rhythm, and then outputs the arbitrary signal to the real-time performance unit at the insertion timing associated with the first rhythm, wherein the synchronization is confirmed by comparing the second rhythm included in MIDI data related to the actually played acoustic sound with the first rhythm included in the MIDI data related to musical score information of a prerecorded acoustic sound.

* * * * *